United States Patent [19]

Yoshimura

[11] Patent Number: 4,831,709

[45] Date of Patent: May 23, 1989

[54] METHOD OF AN APPARATUS FOR REMOVING COUPLING ELEMENTS FROM A SLIDE FASTENER STRINGER TAPE

[75] Inventor: Eiichi Yoshimura, Kurobe, Japan

[73] Assignee: Yoshida Kogyo K. K., Tokyo, Japan

[21] Appl. No.: 153,570

[22] Filed: Feb. 1, 1988

Related U.S. Application Data

[62] Division of Ser. No. 872,290, Jun. 10, 1986, abandoned.

[30] Foreign Application Priority Data

Jun. 10, 1985 [JP] Japan ..... 60-125779

[51] Int. Cl.[4] ..... B21D 53/52

[52] U.S. Cl. ..... 29/426.4; 29/410; 29/426.5; 29/770

[58] Field of Search ..... 29/426.4, 426.5, 408, 29/409, 410, 766, 767, 768, 769, 770

[56] References Cited

U.S. PATENT DOCUMENTS

| | | | |
|---|---|---|---|
| 3,426,752 | 2/1969 | Laico | 29/426.4 X |
| 4,062,100 | 12/1977 | Heimberger | 29/770 |
| 4,246,681 | 1/1981 | Yamada | 29/770 |
| 4,325,185 | 4/1982 | Kanzaka | 29/770 |
| 4,413,398 | 11/1983 | Fisher . | |

FOREIGN PATENT DOCUMENTS

| | | | |
|---|---|---|---|
| 0150508 | 8/1985 | European Pat. Off. . | |
| 2259667 | 1/1975 | France . | |
| 2025514 | 1/1980 | United Kingdom . | |
| 2034805 | 6/1980 | United Kingdom . | |
| 2041072 | 9/1980 | United Kingdom | 29/770 |

*Primary Examiner*—Joseph M. Gorski

*Attorney, Agent, or Firm*—Hill, Van Santen, Steadman & Simpson

[57] ABSTRACT

Each of coupling elements mounted on a slide fastener stringer tape has a coupling head and two legs extending from the coupling head and mounted astride of a longitudinal beaded edge of the stringer tape, the legs being integrally interconnected by a connector extending through the stringer tape. The coupling elements are removed from the stringer tape by gripping the stringer tape between a pair of grippers with the coupling elements supported on the grippers, thrusting cutting edges into the coupling head of each coupling element toward the longitudinal beaded edge to break the coupling head, and driving wedge-shaped spreaders into each coupling element through the broken coupling head thereof to spread each coupling element until the connector is forcibly broken, for thereby breaking each coupling element into two pieces off the stringer tape.

2 Claims, 5 Drawing Sheets

METHOD OF AN APPARATUS FOR REMOVING COUPLING ELEMENTS FROM A SLIDE FASTENER STRINGER TAPE

This is a division, of application Ser. No. 872,290 now abandoned, filed June 10, 1986.

BACKGROUND OF THE INVENTION

1. Field of the invention

The present invention relates to a method of and an apparatus for removing coupling elements from a slide fastener stringer tape.

2. Description of the Prior Art

There are known methods of and apparatus for removing a number of successive coupling elements, which may be either die-cast of metal or injection-molded of synthetic resin, from the beaded edge of a slide fastener stringer tape to provide an element-free space across which the stringer tape will be cut off. One conventional arrangement for such coupling element removal, illustrated in FIG. 7 of the accompanying drawings, is disclosed in Japanese Patent Publication No. 57-61406 published on Dec. 24, 1982. According to this prior design, each of coupling elements A to be removed from a slide fastener stringer tape E is cut into two halves by thrusting a wedge-shaped cutter C into the coupling head of the coupling element A while at the same time spreading out tape grippers D to cause their ends to force two coupling element legs B apart off the stringer tape E.

The above known process is effective in removing slide fastener coupling elements of the type which has legs attached simply astride of a longitudinal beaded edge of a slide fastener stringer tape. Some slide fasteners have coupling elements that are firmly anchored on a slide fastener stringer tape. Each of the coupling elements has two legs mounted astride of a longitudinal beaded edge of a slide fastener stringer tape and interconnected by a connector extending through a hole defined in the stringer tape and covered by the legs. Coupling elements of this type cannot be removed from the stringer tape by the arrangement disclosed in the foregoing publication.

SUMMARY OF THE INVENTION

It is an object of the present invention to provide a method of removing coupling elements from a longitudinal beaded edge of a slide fastener stringer tape, the coupling elements each having two legs integrally interconnected by a connector extending through the stringer tape.

Another object of the present invention is to provide an apparatus for carrying out the above method.

Each of the coupling elements mounted on a slide fastener stringer tape has a coupling head and two legs extending from the coupling head and mounted astride of a longitudinal beaded edge of the stringer tape, the legs being integrally interconnected by a connector extending through the stringer tape. To remove the coupling elements from the stringer tape, the stringer tape is gripped between a pair of grippers with the coupling elements supported on the grippers, and then cutting edges are thrust into the coupling head of each coupling element toward the longitudinal beaded edge to break the coupling head. Thereafter, wedge-shaped spreaders are driven into each coupling element through the broken coupling head thereof to spread each coupling element until the connector is forcibly broken, for thereby breaking each coupling element into two pieces and off the stringer tape.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
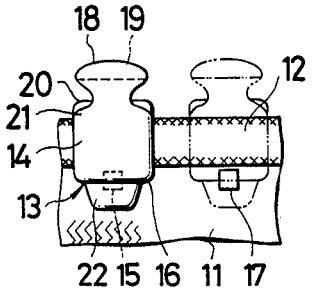
FIG. 1 is an enlarged fragmentary plan view of a coupling element mounted on a longitudinal beaded edge of a slide fastener stringer tape.
Figure 2:
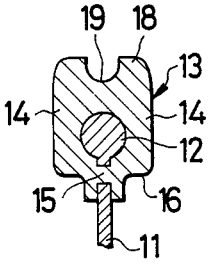
FIG. 2 is a cross-sectional view of the coupling element shown in FIG. 1.
Figure 3:
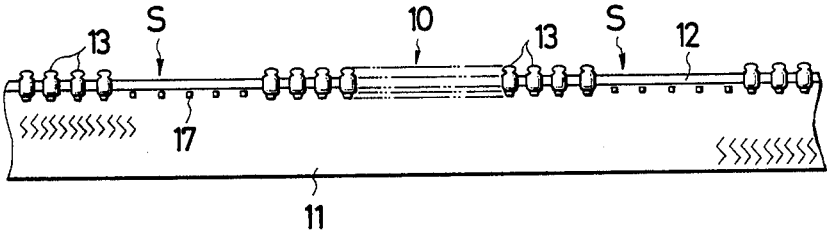
FIG. 3 is a fragmentary plan view of a slide fastener stringer with coupling elements mounted on a longitudinal beaded edge of a slide fastener stringer tape.

FIGS. 1 through 3 illustrate a slide fastener stringer 10 comprising an elongate stringer tape 11 having a longitudinal beaded edge 12 and a series of successive coupling elements 13 die-cast of metal or injection-molded of synthetic resin and mounted on the longitudinal beaded edge 12 at suitable intervals. As shown in FIGS. 1 and 2, each of the coupling elements 13 has two legs 14 mounted astride of the longitudinal beaded edge 12 and extending beyond the longitudinal beaded edge 12 over the opposite surfaces of the stringer tape 11. To anchor the coupling elements 13 firmly on the stringer tape 11, the legs 14 of each coupling element 13 are integrally interconnected by a connector 15 positioned at the rear ends 16 of the legs 14 and extending through a hole 17 defined in the stringer tape 11 near the beaded edge 12. The coupling elements 13 thus securely mounted on the stringer tape 11 are suitable especially for heavy-duty use where they are subject to undue lateral loads that would otherwise tend to rip off the coupling elements 13.

Each of the coupling elements 13 has a coupling head 18 remote from the rear ends 16 of the legs 14 and having a recess 19, and a pair of ridges 20 on respective shoulders 21 spaced rearwardly from the coupling head 18. When the series of coupling elements 13 and another series of companion coupling elements (not shown) are brought into intermeshing engagement by a slider (not shown) to close a slide fastener, the recesses 19 of the coupling heads 18 receive the ridges 20 of the companion coupling elements to allow secure coupling engagement between the two meshing series of coupling elements. From the rear end 16 of each coupling element leg 14, there extends a thin tongue 22 in contact with the stringer tape 11, the tongue 22 serving as a guide for the slider as it moves along the series of coupling elements 13 to open or close the slide fastener.

According to the present invention, a certain successive number of such coupling elements 13 is removed from the stringer tape 11 to provide an element-free space S (FIG. 3) across which the slide fastener stringer 10 will be cut off.

Figure 4:
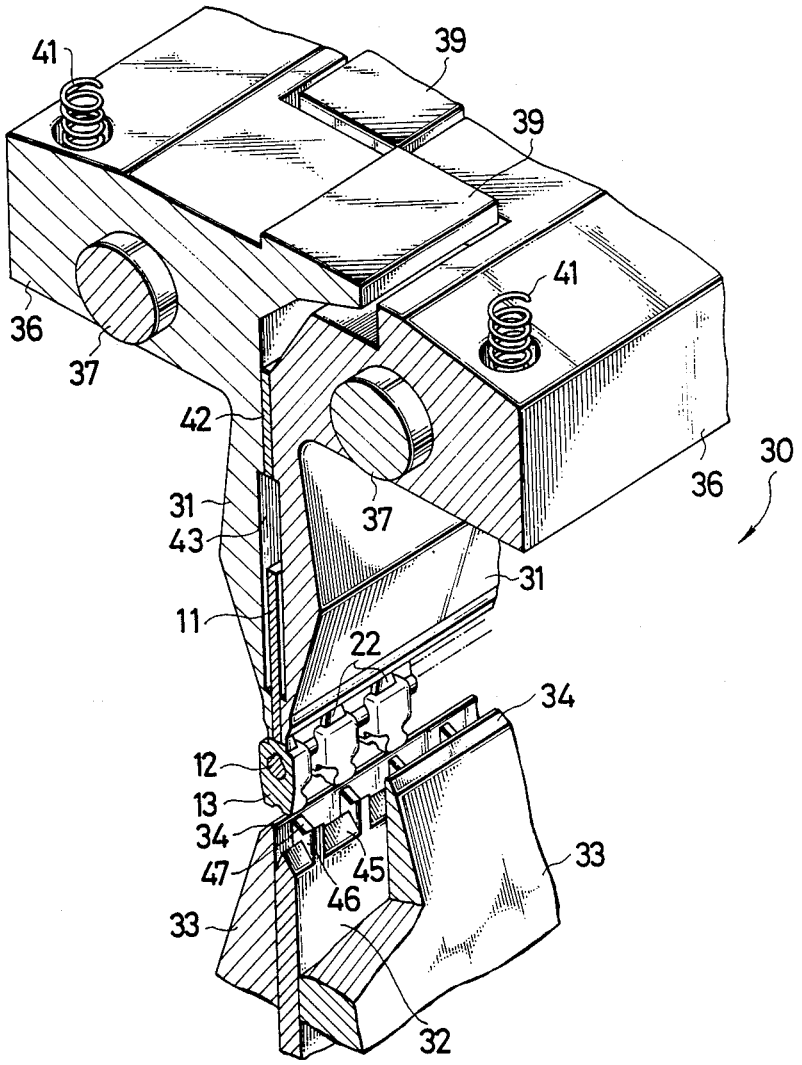
FIG. 4 is a fragmentary perspective view, partly in cross section, of an apparatus for removing coupling elements from a slide fastener stringer tape according to the present invention.
Figure 5:
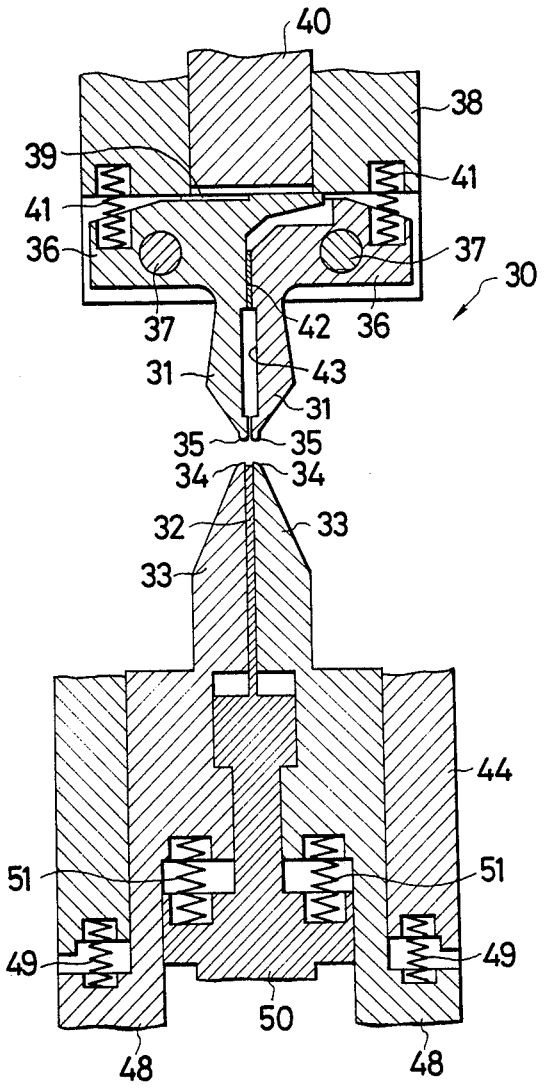
FIG. 5 is a fragmentary vertical cross-sectional view of the apparatus illustrated in FIG. 4.

FIGS. 4 and 5 show an apparatus for removing coupling elements 13 from a slide fastener stringer tape 11, the apparatus being generally denoted at 30. The apparatus 30 essentially comprises a pair of grippers 31 for gripping the slide fastener stringer tape 11 therebetween with the coupling elements 13 positioned downwardly, a central punch 32 disposed below the grippers 31 for thrusting into the coupling heads 18 to break the coupling elements 13 each into two pieces, and a pair of side punches 33 disposed one on each side of the central punch 32 and having wedge-shaped spreaders 34, respectively, on their upper ends for spreading the broken pieces of the coupling elements 13.

The grippers 31 have lower supporting edges 35, respectively, on their lower ends. When the stringer tape 11 is clamped between the grippers 31, the ends of the tongues 22 of the coupling elements 13 are held against the supporting edges 35 for immovably supporting the coupling elements 13 on the grippers 31. The gripers 31 have upper foot members 36 angularly movably supported by a pair of parallel shafts 37, respectively, connected to an upper block 38. The upper foot members 36 have upper surfaces 39 engaged by a piston rod 40 of an air cylinder (not shown) mounted on the upper block 38. When the air cylinder is actuated to extend the piston rod 40, the upper surfaces 39 are pushed downwardly to cause the grippers 31 to turn in opposite directions about the shafts 37 for spreading the lower ends thereof apart from each other. The grippers 31 are normally urged by compression coil springs 41 acting between the grippers 31 and the upper block 38 to turn in a direction to bring their lower ends together. Between the upper foot members 36, there is disposed a spacer 42 for keeping the lower ends of the grippers 31 spaced a certain distance from each other when the grippers 31 are brought together under the resiliency of the compression coil springs 41, the distance being selected to be slightly greater than the thickness of the stringer tape 11. Therefore, even when the stringer tape 11 is gripped between the grippers 31, the stringer tape 11 can be moved in its longitudinal direction. The grippers 31, when brought together, jointly define a cavity 43 therebetween. The upper block 38 is vertically movable by a certain stroke by means of a suitable drive source such as an air cylinder (not shown) for the reason described below.

The central punch 32 is vertically movable by a certain stroke toward the grippers 31 by means of suitable drive source such as an air cylinder (not shown) disposed below a fixed lower block 44 (FIG. 5). The central punch 32 has as many cutting edges 45 on its upper end as the number of coupling elements 13 to be removed from the stringer tape 11, the cutting edges 45 being spaced at equal intervals in the longitudinal direction of the central punch 32. Each of the cutting edges 45 is of a triangular cross section. The central punch 32 also has a plurality of tape displacers 46 positioned on the upper end thereof between adjacent ones of the cutting edges 45 and projecting toward the grippers 31. The tape displacers 46 have upwardly opening recesses 47 defined respectively in upper ends thereof for receiving the beaded edge 12 of the stringer tape 11. The recesses 47 have lower bottoms higher than the tips of the cutting edges 45.

The side punches 33 are vertically movable by a certain stroke toward the grippers 31 by means of another suitable drive source such as an air cylinder (not shown) disposed below the lower block 44. Each of the wedge-shaped spreaders 34 has a length corresponding to that of the succession of coupling elements 13 to be removed, and has its uppermost tip positioned closely to the central punch 32. The side punches 33 have respective legs 48 vertically slidably disposed in the lower block 44. Compression coil springs 49 are interposed between the lower block 44 and the legs 48 for normally urging the side punches 33 to move downwardly away from the grippers 31. The central punch 32 is mounted on a punch support 50 slidably disposed between the side punch legs 48. The central punch 32 is normally urged to move downwardly away from the grippers 31 by a number of compression coil springs 51 acting between the punch support 50 and the side punch legs 48. The central punch 32 and the side punches 31 are thus interlinked by the compression coil springs 51 such that when the side punches 33 are lowered, the central punch 32 is also lowered therewith to allow the stringer tape 11 to be longitudinally delivered smoothly and safely after removal of coupling elements 13 therefrom.

Operation of the apparatus 30 for removing coupling elements 13 from the stringer tape 11 will be described with reference to FIGS. 6A through 6E.

In preparation for coupling element removal, a portion of the stringer tape 11 from which coupling elements 13 are to be removed is sandwiched between the grippers 31 with the ends of the tongues 22 held against the supporting edges 35 to hold the coupling elements 13 in position. The central punch 32 and the side punches 33 are retracted to their lowermost positions below the grippers 31, and the cutting edges 45 and the tape displacers 46 are positioned slightly beneath the tips of the spreaders 34 of the side punches 33.

Figure 6A:
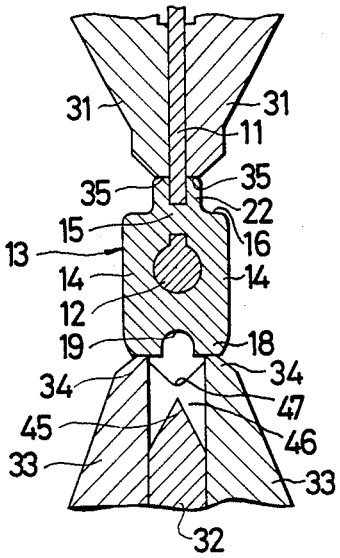
FIGS. 6A through 6E are fragmentary cross-sectional views showing a sequence of progressive steps of coupling element removal.
Figure 6B:
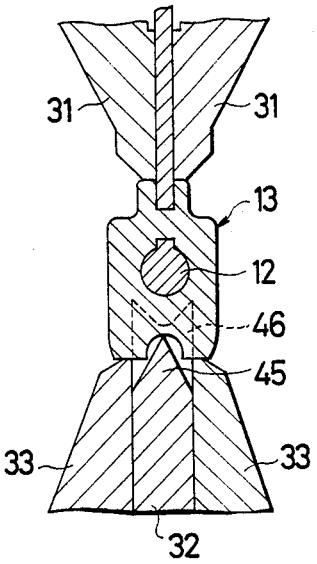
Figure 6C:
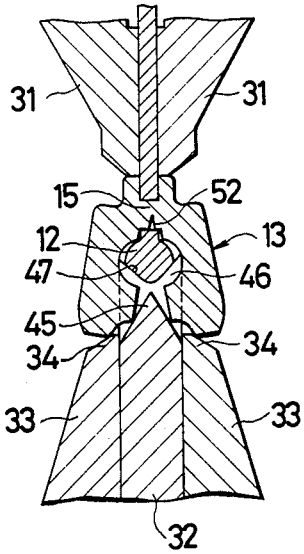

The central punch 32 and the side punches 33 are moved upwardly by the respective drive sources until the tips of the spreaders 33 engage the coupling heads 18 to hold the coupling elements 13 stably in position between the supporting edges 35 and the spreaders 33, as shown in FIG. 6A. Thereafter, only the central punch 32 continues to be moved upwardly to cause the cutting edges 45 to reach the bottoms of the recesses 19 in the coupling heads 18, as shown in FIG. 6B. Continued upward movement of the central punch 32 enables the cutting edges 45 to thrust into the coupling elements 13 toward the beaded edge 12, thus cutting the coupling heads 18 into two halves, as shown in FIG. 6C. During this time, the tape displacers 46 reach the beaded edge 12 of the stringer tape 11 and their recesses 47 push the beaded edge 12 upwardly away from the cutting edges 45, so that the beaded edge 12 will not be damaged by the cutting edges 45.

Figure 6D:
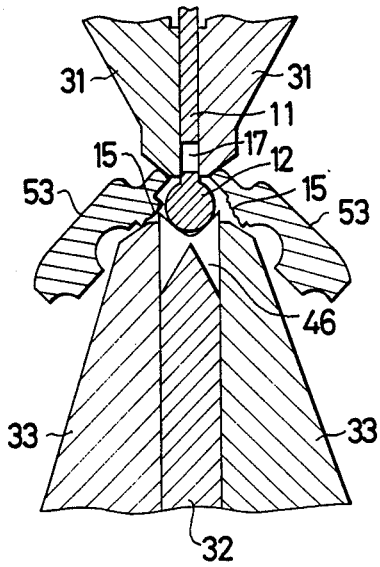

When the coupling heads 18 are broken into two halves, the spreaders 33 of the side punches 33 are driven upwardly to force the separated coupling heads 18 further apart, producing a crack 52 in each of the connectors 15 as shown in FIG. 6C. Upon further ascending movement of the side punches 33, each of the spreaders 34 is wedged into each of the coupling elements 13 to break it all the way into two pieces 53, as shown in FIG. 6D, whereupon the coupling element pieces 53 come off the stringer tape 11. The central punch 32 is also moved upwardly at this time to cause the tape displacers 46 to lift the beaded edge 12 for thereby pushing the stringer tape 11 into the cavity 43 between the grippers 31. This upward movement of the beaded edge 12 and hence the stringer tape 11 assists in breaking the coupling elements 13 for complete removal thereof from the stringer tape 11. At this time, the stringer tape 11 can be lifted unobstructedly between the grippers 31 since there is a suitable gap provided between the grippers 31 by the spacer 42, as described above.

Figure 6E:
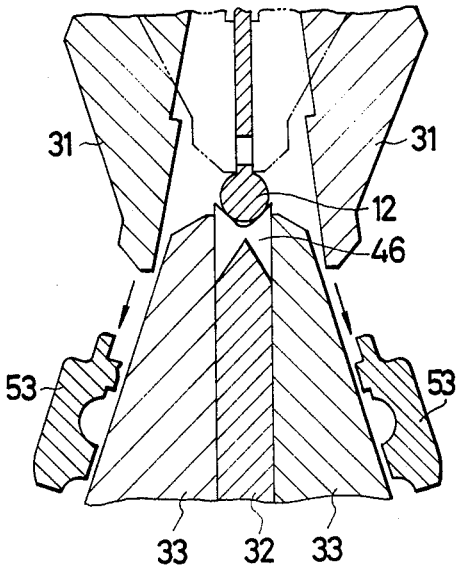
Figure 7:
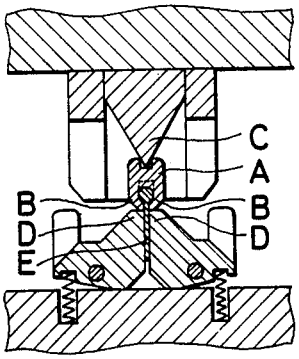
FIG. 7 (PRIOR ART)
FIG. 7 is a fragmentary vertical cross-sectional view of a conventional apparatus for removing coupling elements from a slide fastener stringer tape.

Immediately after each coupling element 13 is split into its pieces 53, the piston rod 40 is lowered to turn the grippers 31 away from each other about the respective shafts 37 and, at the same time, the upper block 38 is lowered. The grippers 31 with their lower ends spaced from each other are now moved downwardly along the outer sides of the side punches 33, as shown in FIG. 6E, for positively and reliably removing coupling element pieces 53 from the stringer tape 11. Thereafter, the piston rod 40 and the upper block 38 are moved back upwardly to cause the grippers 31 to grip the stringer tape 11. Then, the central punch 32 and the side punches 33 are moved back downwardly. The stringer tape 11 as it is gripped between the grippers 31 is fed longitudinally until a next portion thereof from which coupling elements 13 are to be removed is supported by the grippers 31. Alternatively, the stringer tape 11 may be fed longitudinally when the grippers 31 are spaced apart from each other as shown in FIG. 6E.

The above cycle shown in FIGS. 6A through 6E is repeated to remove selected coupling elements 13 from the stringer tape 11 for producing longitudinally spaced coupling-element free spaces S on the stringer tape 11 as shown in FIG. 3.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A method of removing coupling elements from a slide fastener stringer tape, each of the coupling elements having a coupling head and a pair of legs extending from the coupling head and terminating in rear ends, said legs being mounted astride a longitudinal beaded edge of the stringer tape and integrally interconnected by a connector extending through the stringer tape, said method comprising the steps of:

(a) gripping the stringer tape between a pair of grippers with said rear ends of the coupling elements resting against said grippers, respectively;

(b) holding the coupling elements by and between said pair of grippers and a pair of wedge-shaped spreaders disposed in confronting relation to the pair of grippers, respectively, with said pair of spreaders engaging the coupling heads of said coupling elements;

(c) upon said holding of the coupling elements, thrusting a cutting edge between the pair of spreaders into the coupling heads of said coupling elements toward said longitudinal beaded edge, thereby breaking the coupling heads;

(d) then forcing the wedge-shaped spreaders into the broken coupling heads, thereby spreading apart said coupling elements until said connectors are broken, thereby separating each coupling element into two pieces; and (e) thereafter moving the pair of grippers apart from each other and along outer sides of the wedge-shaped spreaders thereby spreading apart the broken coupling elements and removing the pieces from said stringer tape.

2. A method according to claim 1, further including the step of pushing said beaded edge of the stringer tape apart from the broken coupling elements during said forcing.

* * * * *